US005201857A

United States Patent [19]

Nix

[11] Patent Number: 5,201,857

[45] Date of Patent: Apr. 13, 1993

[54] COOL SPRAY RETURN ADAPTOR

[76] Inventor: Terry G. Nix, 130 Couch St., Easley, S.C. 29640-2418

[21] Appl. No.: 762,841

[22] Filed: Sep. 19, 1991

Related U.S. Application Data

[63] Continuation-in-part of Ser. No. 579,037, Sep. 7, 1990, abandoned.

[51] Int. Cl.[5] ..... E04H 4/14

[52] U.S. Cl. ..... 4/492; 4/496

[58] Field of Search ..... 4/490, 492, 494, 496, 4/504, 507; 239/17, 20

[56] References Cited

U.S. PATENT DOCUMENTS

| | | | |
|---|---|---|---|
| 1,896,202 | 2/1933 | Richardson | 4/492 X |
| 2,439,866 | 4/1948 | Saladin | 4/492 X |
| 3,030,028 | 4/1962 | Hruby, Jr. | 4/496 X |
| 3,318,528 | 5/1967 | Williams | 4/496 X |
| 3,411,163 | 11/1968 | Myers, Jr. | 4/493 X |
| 3,577,571 | 5/1971 | Bellinson et al. | 4/490 X |
| 3,722,816 | 3/1973 | Stewart et al. | 4/507 X |
| 3,831,852 | 8/1974 | Stillman, Jr. | 4/492 X |
| 4,241,464 | 12/1980 | Buckwalter | 4/492 X |

*Primary Examiner*—Henry J. Recla
*Assistant Examiner*—Robert M. Fetsuga

[57] ABSTRACT

An adapter for connection to the return line of a pool filtering system. A series of pipe and fittings are assembled to produce a "T"-shaped unit which contains a pressure control valve and that is readily connected to the existing filtering system of the pool. A portion of the water being returned to the pool is diverted through a nozzle section by means of the control valve in a lower section of the unit. Connected to the control valve is a 45 degree angle hollow fitting which is rotatable, allowing adjustment of unidverted return water pressure for the purpose of moving any top water debris into the skimmer of the filtering system. The nozzle has a slip-fit cap system allowing easy adjustment of spray pattern.

6 Claims, 1 Drawing Sheet

COOL SPRAY RETURN ADAPTOR

This application is a continuation-in-part of an application Ser. No. 07/579,037, filed on Sep. 07, 1990, now abandoned.

BACKGROUND OF THE INVENTION

This invention relates to swimming pools and fountains which can be instantly connected to the return line exit valve of the existing filtering system of the pool. Fountains of this design in the past have encountered difficulties such as having to install extra tubing and valves in the filtering system providing them complete control over the spray created by the fountain. Without pressure control the nozzle would have to be designed to accommodate the full amount of water pressure created by the filtering system pump. Also, the spray action of the fountain tends to push any top water debris toward the opposite wall of the pool instead of moving it around to skimming device. This action defeats the effectivenes of the skimmer in the cleaning of top water debris.

Therefore, it would be desirable to have a single unit that creates a pressure controlled fountain and is able to direct undiverted water pressure in direction best suited for moving any top water debris around to skimmer.

SUMMARY OF THE INVENTION

This invention discloses a controlled fountain spraying system and top water skimming aid for swimming pools in one compact unit. Where as, the structure of the unit has a self-contained, adjustable pressure control valve and a directional valve which is also adjustable for the purpose of directing undiverted return water pressure in any direction.

This unit also incorporates a nozzle system with changable slip-fit nozzle caps, thus, giving the ability of changing spray pattern or design by the simple twist of a hand. Also, a multitude of spray head extentions can be designed for this unit.

Therefore, the primary objective of this invention is to provide a compact self-contained fountain system that is simple enough for the average pool owner to install.

Other objectives may become apparent as this specification progresses.

FIGS. **6*a*–6*e*** are front views of some of the many different spray head designs that can be used with this unit.

DESCRIPTION OF THE PREFERRED EMBODIMENT

Figure 1:
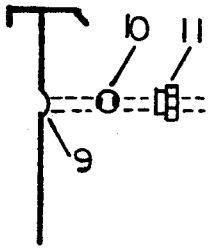
FIG. 1 is a side view of the filtering system return receptacle 9 which contains the directional ball 10 and retainer ring 11 which this unit is designed to replace.
Figure 2:
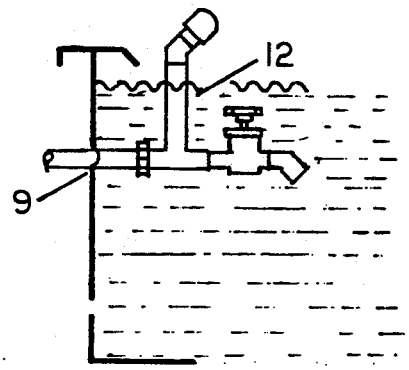
FIG. 2 illustrates the present unit 12 connected to the return receptacle 9 with the filtering system in operation.
Figure 3:
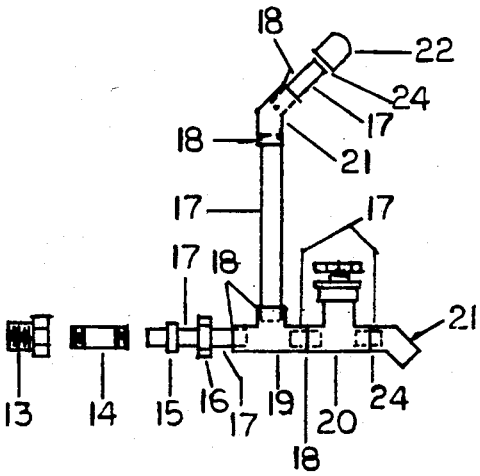
FIG. 3 is a side view of the unit 12 showing its basic construction.
Figure 4:
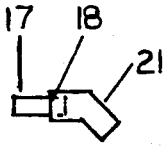
FIG. 4 is a side view of the directional valve.
Figure 5:
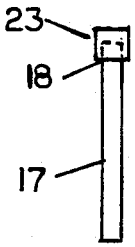
FIG. 5 is a side view of a nozzle height extension, to accommodate pools which have return lines that enter the pool wall at a greater distance from the top of the pool.
Figure 6A:
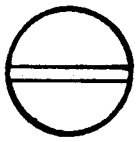
Figure 6B:
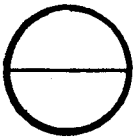
Figure 6C:
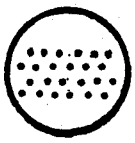
Figure 6D:
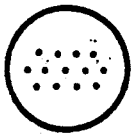
Figure 6E:
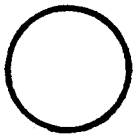

Referring to FIG. 3 of the drawings where in: a threaded bushing 13 is supplied for matching return receptacle 9 size when necessary, a section of piping 14 threaded on both ends provides a means for connection of nozzle section to filtering system return receptacle 9. Lengths of tubing 17 cut to the appropriate sizes and appropriate fittings are assembled in a generally upside down T shape wherein, one bottom end of a T connector 19 is connected to the section of threaded pipe 14 by retaining nut 16 and rubber seal 15, the opposite bottom end of the T 19 is connected to an adjustable pressure control valve 20 to which is connected a 45 degree hollow fitting 21, and the vertical leg of the T terminates just above normal water level in a 45 degree angle 21 providing nozzle connection for spray head 22. The control valve allows adjustment of water flow through the vertical leg. FIGS. **6*a*–6*d* illustrate some possible spray head 22 patterns. These can vary in spray opening shape and size. For instance, the shape of FIG. 6*a* can be of one-quarter inch size. Similarly, FIGS. 6*b*–6*d* can be of one-thirty second, one-sixteenth and one-thirty second inch sizes, respectively. FIG. 6*e* illustrates a closure cap. Designated joints 18 are cemented while other joints 24** have a rotatable slip-fit connection, all parts are constructed of PVC material although other materials may be substituted.

I claim:

1. A fountain adapter for swimming pools having at least one removable jet threaded into a circulation system water return line mounted in a wall thereof, said fountain adapter comprising:

a plurality of tubing sections connected together in a "T"-shaped configuration, one end portion of the cross of said T being threaded for connection to said return line upon removal of said jet therefrom, an opposite end portion of said cross having an adjustable control valve connected thereto for controlling water flow therethrough, a free end portion of the leg of said T having a hollow, angled fitting connected thereto, said T being oriented generally upside down when connected to said return line with said angled fitting directed towards an interior of the pool;

whereby, water flowing from said return line can be caused selectively to exit said angled fitting by manipulation of said control valve.

2. A fountain adapter according to claim 1, further comprising a second hollow, angled fitting connected downstream of said valve.

3. A fountain adapter according to claim 2, wherein said second angled fitting is rotatably adjustable.

4. A fountain adapter according to claim 1, wherein said angled fitting is rotatably adjustable.

5. A fountain adapter according to claim 1, further comprising a plurality of differently patterned spray heads each releasably connectable to said angled fitting.

6. A fountain adapter according to claim 1, further comprising a closure cap releasably connectable to said angled fitting.

* * * * *